US009856697B2

(12) United States Patent
Reyes

(10) Patent No.: US 9,856,697 B2
(45) Date of Patent: Jan. 2, 2018

(54) DOUBLE LADDER ELEVATOR

(71) Applicant: Eutimio Reyes, Miami, FL (US)

(72) Inventor: Eutimio Reyes, Miami, FL (US)

( * ) Notice: Subject to any disclaimer, the term of this patent is extended or adjusted under 35 U.S.C. 154(b) by 0 days.

(21) Appl. No.: 14/228,226

(22) Filed: Mar. 27, 2014

(65) Prior Publication Data

US 2015/0275579 A1 Oct. 1, 2015

(51) Int. Cl.
*E06C 7/16* (2006.01)
*E06C 7/12* (2006.01)
*E06C 1/12* (2006.01)

(52) U.S. Cl.
CPC ..... *E06C 7/16* (2013.01); *E06C 7/12* (2013.01); *E06C 1/12* (2013.01)

(58) Field of Classification Search
CPC ..... E06C 7/12; E06C 7/16; E06C 1/12
See application file for complete search history.

(56) References Cited

U.S. PATENT DOCUMENTS 976,240 A * 11/1910 Winkler ..... 182/103
2,499,975 A 3/1950 Robshaw
3,115,211 A * 12/1963 Ostrander, Jr. ..... 182/103
3,215,254 A 11/1965 Otto
3,237,719 A * 3/1966 Russell ..... 182/103
3,666,054 A * 5/1972 Ellings et al. ..... 182/103
4,183,423 A * 1/1980 Lewis ..... 182/103
5,275,256 A * 1/1994 Ellzey ..... 182/103
6,244,381 B1 * 6/2001 Ruble ..... 182/103
6,533,070 B1 * 3/2003 Elrod ..... 182/103
7,424,932 B1 * 9/2008 Murphy ..... 182/103

FOREIGN PATENT DOCUMENTS

NL 9301431 A * 3/1995

* cited by examiner

*Primary Examiner* — Colleen M Chavchavadze
(74) *Attorney, Agent, or Firm* — Ruben Alcoba, Esq.

(57) ABSTRACT

An elevator climbs and lifts loads along the length of a double ladder. The double ladder comprises a first ladder and a second ladder that join together to form an overlap portion. The overlap portion is wider and generally less stable than the individual ladders. The elevator helps overcome the physical barriers imposed at the overlap portion. The elevator utilizes guiding mechanisms having different orientations and designs to smoothly cross over misalignments and instable structures in the double ladder. The elevator includes a housing. The underside of the housing includes guide units that ride the side rails to align a first ladder and a second ladder. Rollers press the housing in contact to the ladders. Notched rollers suppress vibrations on the housing. The guide mechanisms selectively engage the ladders and the overlap portion based on the position of the elevator. A motorized platform extends from the housing.

16 Claims, 6 Drawing Sheets

DOUBLE LADDER ELEVATOR

BACKGROUND

Figure 1A:
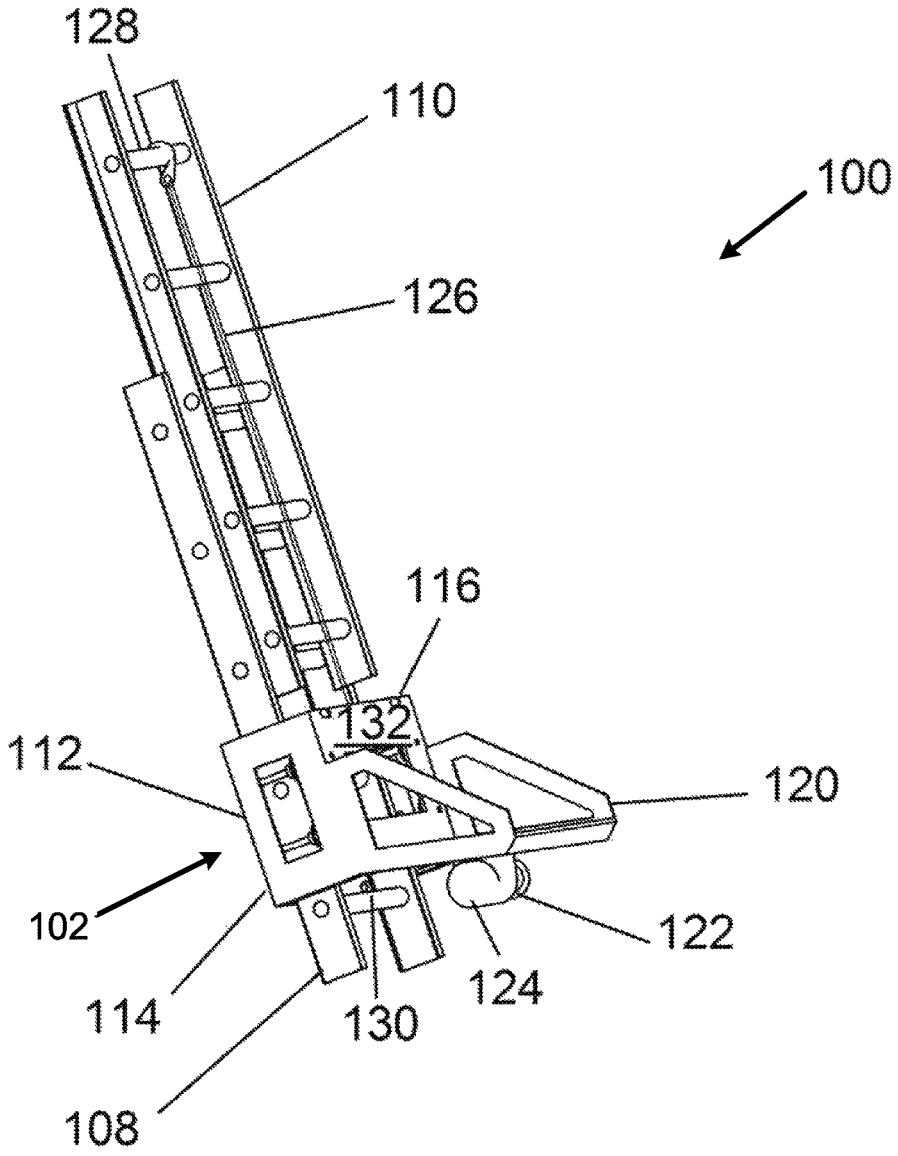

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon.

The present invention is directed to an elevator that traverses a double ladder in a smooth continuous path. The elevator uses specially oriented and aligned rollers and wheels to engage the side rails. The rollers and wheels can selectively engage either ladder, or the overlap portion between the ladders, depending on the position of the elevator on the double ladder.

It is well known that ladders have been commonly used in order to carry a person or worker up or down along a building wall or other structure. Ladders can include a rigid pair of side rails connected by horizontal rungs. Sometimes, two or more ladders can be joined to extend the potential height of the ladder.

It can sometimes be problematic to carry heavy objects to the top of a house, to a second or higher story of a building, or onto a roof. For example, carrying heavy materials like shingles up a ladder with hands is a dangerous proposition in that carrying such materials may require the use of both hands. Furthermore, manually carrying multiple packages of shingles, tools, or perhaps beverages is likely to require multiple trips up and down the ladder, which creates a more dangerous climbing scenario.

Often, the lifting can be accomplished with a crane, but the expense of using a crane is often prohibitive. The manpower to operate the crane might not be available. In addition, it would be difficult and expensive to transport a large piece of equipment such as a crane to a job site.

Often, a specially configured elevator is used to automatically climb the ladder. The elevator is a motorized platform that rides the side rails of the ladder to move up and down the ladder. However, if the ladder is a double or triple ladder having more than one individual sections, the junction between the ladders is generally wider and less stable than at the single ladder sections. The elevator may not be able to cross these junctions where the ladders overlap.

For the foregoing reasons, there is an elevator that traverses a double ladder in a smooth, continuous path through the use of strategically placed guides and rollers that engage specific surfaces and flanges on the double ladder.

Elevators for ladders have been utilized in the past; yet none with the present double ladder climbing capacity of the present invention. See U.S. Pat. Nos. 2,499,975; 3,215,254; and 6,782,972.

For the foregoing reasons, there is a double ladder elevator that traverses double ladders in a first position, a second position, and an overlap position.

SUMMARY

The present invention is directed to an elevator that is effective for lifting loads along the length of a double ladder.

The elevator utilizes guiding mechanisms having different orientations and designs to smoothly cross over misalignments, instabilities, and wide sections on the double ladder. In some embodiments, the double ladder comprises a first ladder and a second ladder that join together to form an overlap portion. The overlap portion is wider and generally less stable than the individual ladders. The present invention helps overcome the physical barriers imposed at the overlap portion.

For better understanding the elevator, the first ladder is oriented to engage a ground surface for support, while the second ladder is oriented above the first ladder. The first and second ladders join at an overlap portion that is wider than the individual ladders, and can often form a staggered, misaligned section of the double ladder for the elevator to traverse. The elevator moves between each ladder and the overlap portion in a smooth, continuous path. The guiding mechanisms on the underside of the elevator move between engagement and disengagement of each ladder and the overlap portion based on the movement and location of the elevator relative to the double ladder.

The elevator includes four guide units that guide the elevator along a longitudinal axis of the double ladder. Each guide unit includes three spaced wheels joined together by a guide axis. The outer wheels engages one of the ladders and the overlap portion. The central wheel straddles both ladders. The guide units create stability, yet have sufficient flexibility to allow for play between the elevator and the double ladders.

The elevator further includes eight rollers that roll along the outer side rails of each ladder. The rollers exert an inward pressure from the elevator towards the double ladder. Four of the rollers engage the first ladder and the overlap portion, and four oppositely positioned rollers engage the second ladder and the overlap portion. The rollers may include rubber rollers sized to straddle along the side rails.

The elevator also utilizes notched rollers that orient perpendicularly to each other and form tight fittings with different surfaces on the side rails. The notched rollers suppress vibrations and slippage between the elevator and the ladders. All of the guiding mechanisms work together to create a synergy that enables a smooth continuous path of travel across the individual ladders and the overlap portion.

One objective of the present invention is to provide a ladder elevator that crosses over a double ladder.

Another objective is to carry heavy loads up a double ladder.

Another objective is to provide relatively inexpensive wheels and rollers in a strategically aligned configuration to overcome the physical barriers at the junction of a first ladder and a second ladder.

Another objective is to maintain inward pressure from the elevator towards the side rails to increase friction and provide a smooth conveyance of the elevator.

Another objective is to suppress vibrations on the elevator while traversing the double ladder.

Another objective is to regulate operation of the elevator with a foot pedal.

Another objective is to manufacture an elevator for a double ladder that is easy to use and economical to manufacture.

DRAWINGS

Figure 1B:
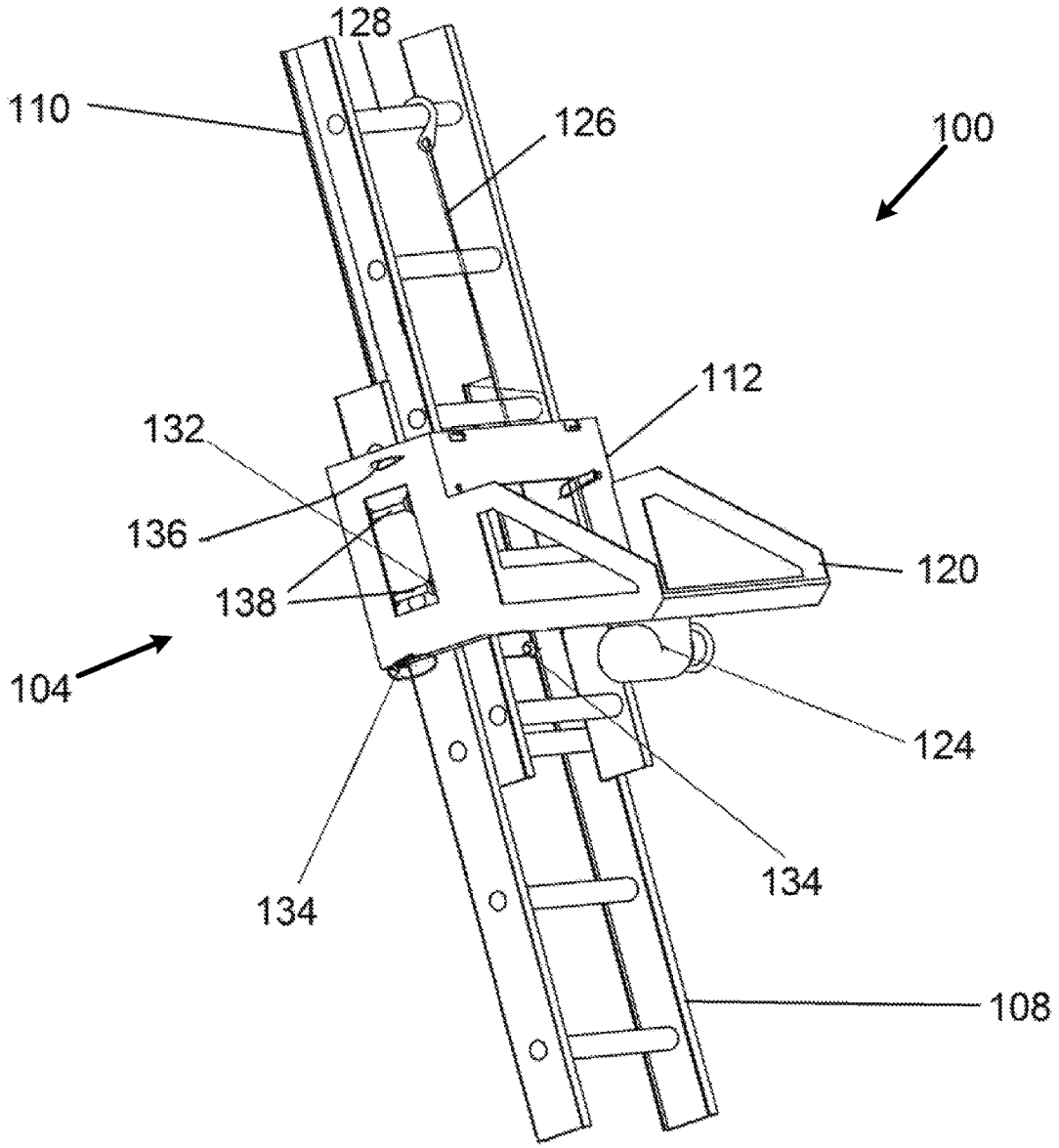
Figure 1C:
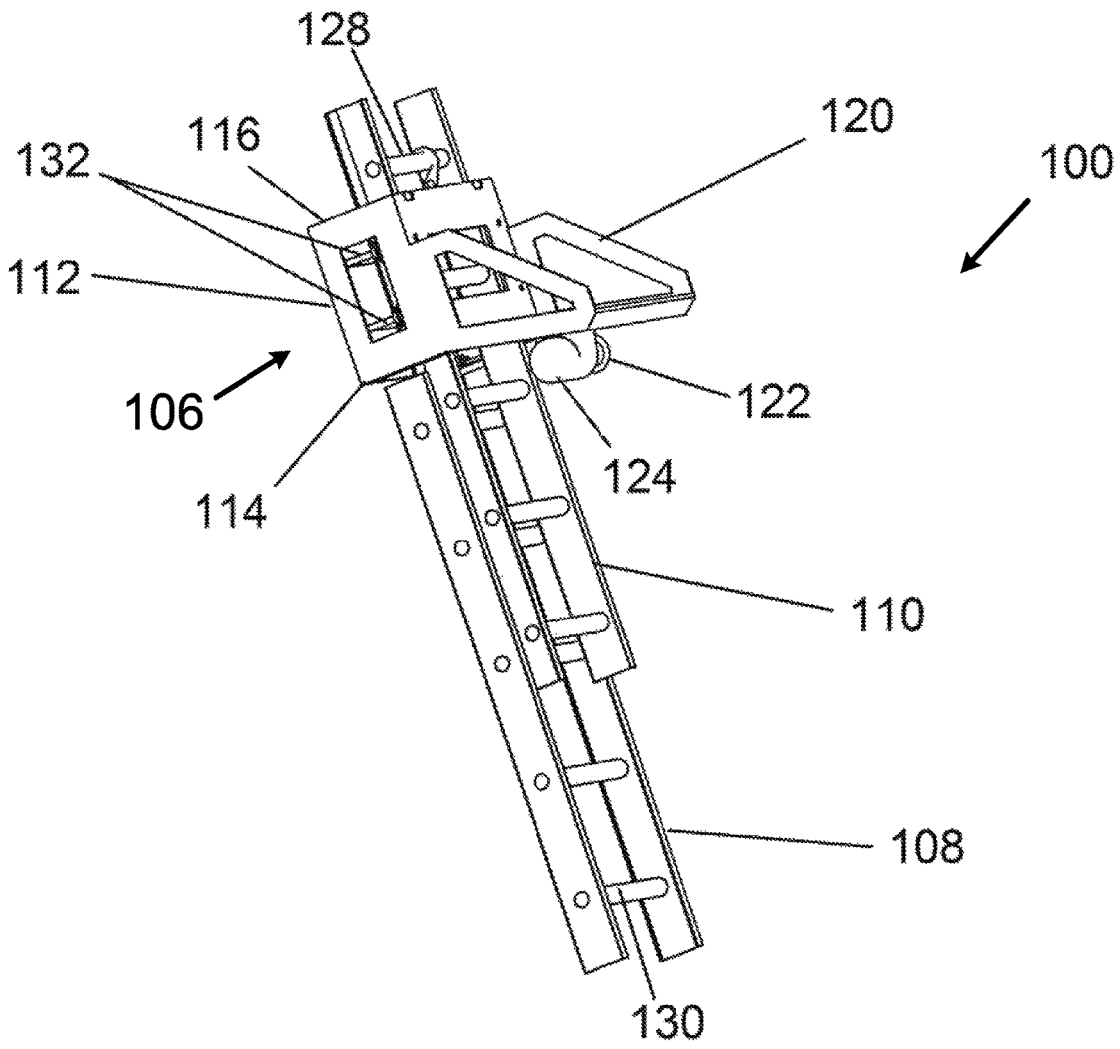
Figure 2A:
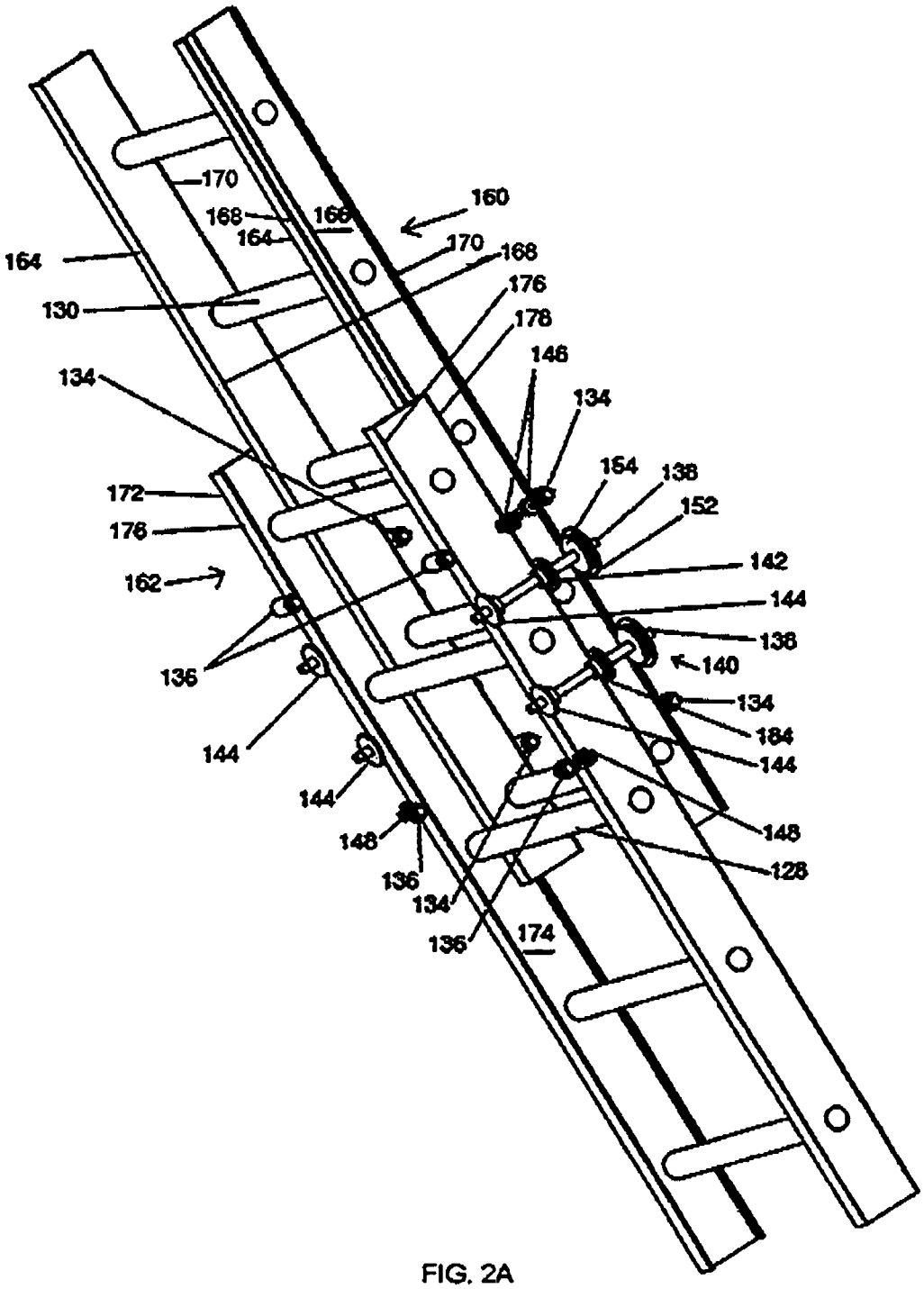
Figure 2B:
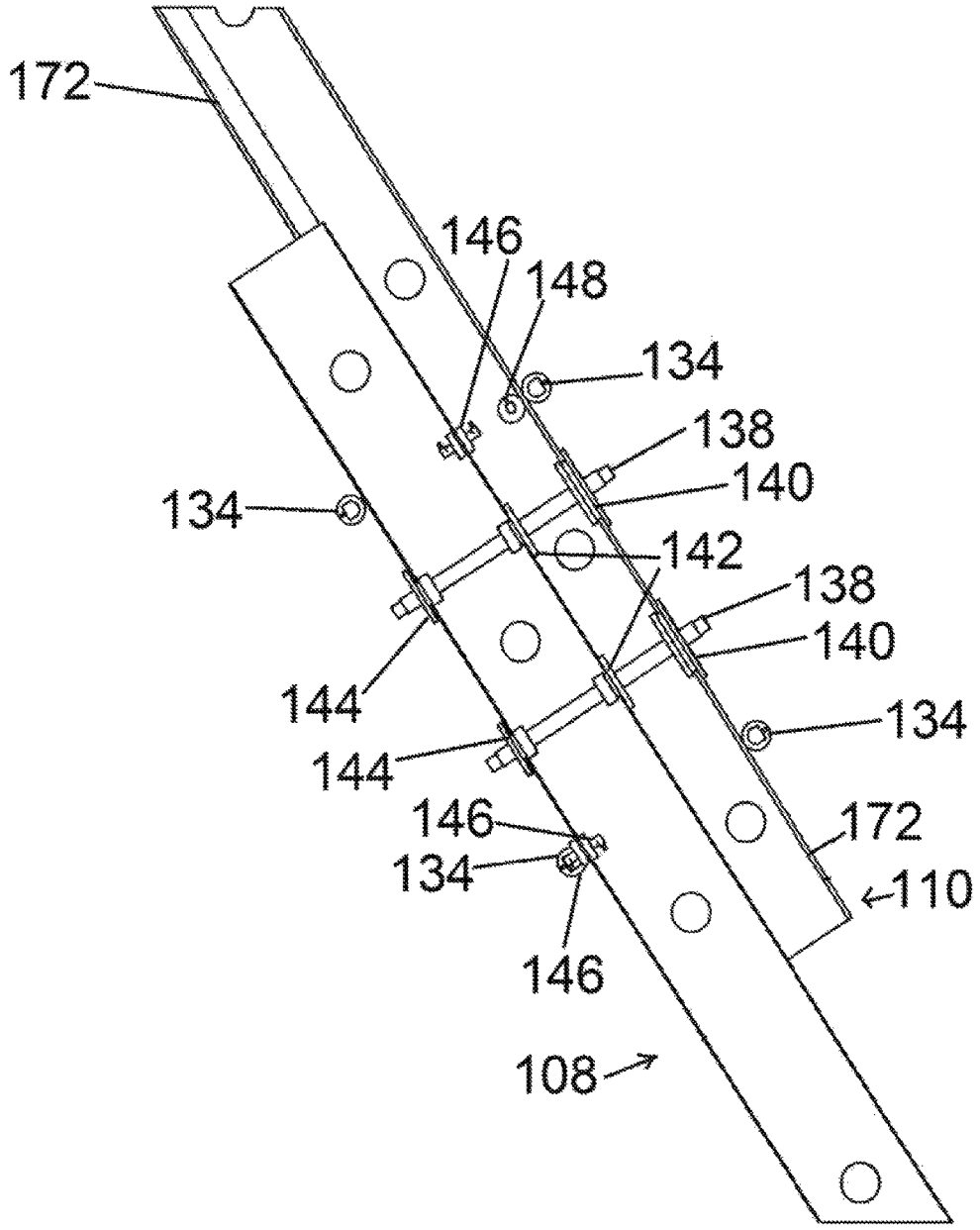
Figure 3:
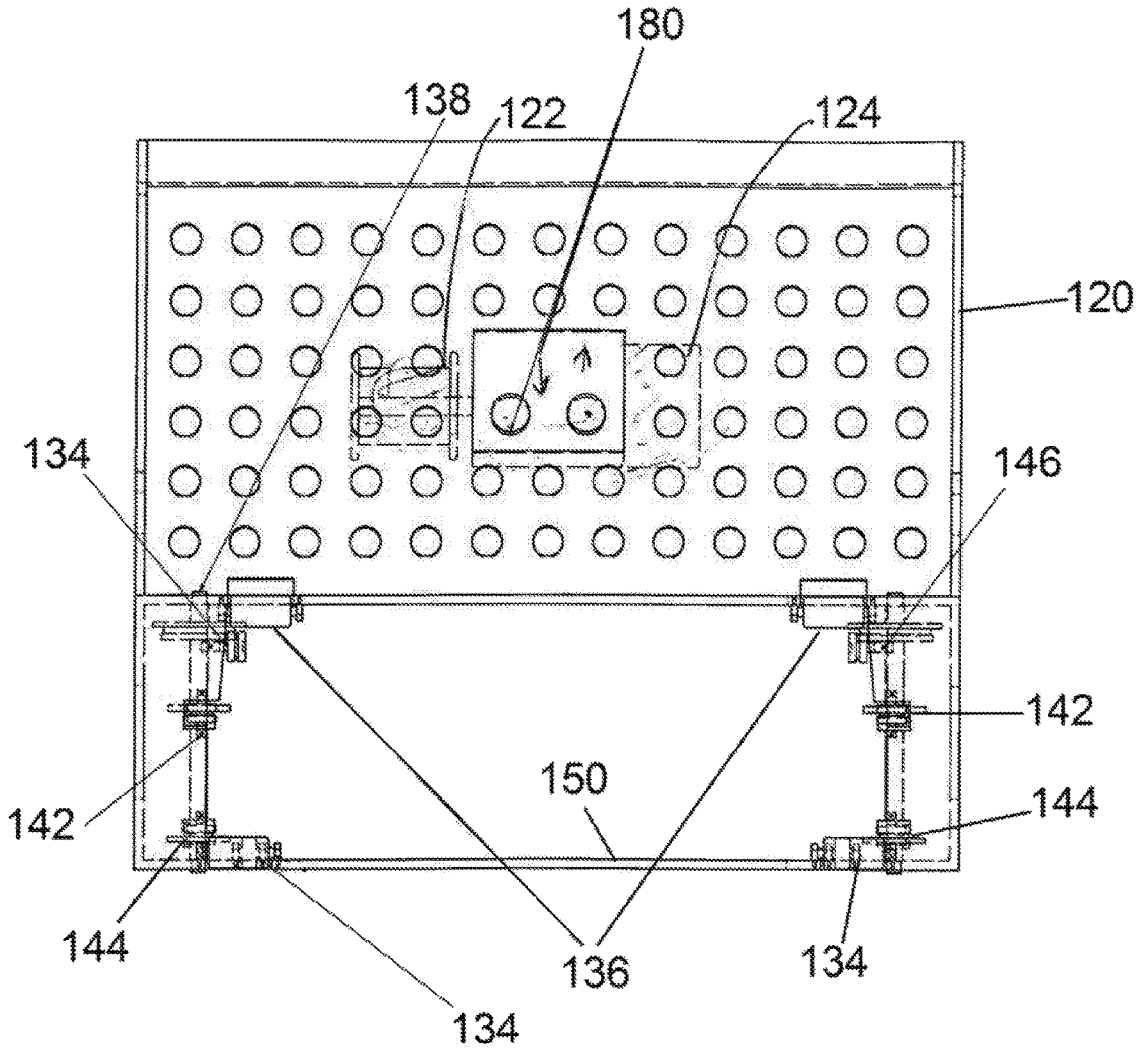

These and other features, aspects, and advantages of the present invention will become better understood with regard to the following description, appended claims, and drawings where:

FIGS. 1A, 1B, and 1C are detailed perspective views of an exemplary elevator traversing an exemplary double ladder, where FIG. 1A is the elevator in a first position, FIG. 1B is the elevator in an overlap position, and FIG. 1C is the elevator in a second position;

FIGS. 2A and 2B are side views of exemplary double ladders and various wheels and rollers from the inner surface of the housing, where FIG. 2A is a detailed perspective view, and FIG. 2B is an elevated side view, and FIG. 3 is a sectioned top view of an exemplary platform projecting out from the elevator and the wheels and rollers in the housing.

DESCRIPTION

FIGS. 1A-3 illustrate one embodiment of an elevator 100 engaged with a double ladder 182. The present invention is directed to an elevator 100 that traverses a double ladder 182 in a smooth continuous path. The elevator 100 uses specially oriented and aligned rollers and wheels to engage the side rails of the two separate ladders. The rollers and wheels can selectively engage either ladder, or the overlapping between the two ladders, depending on the position of the elevator 100 on the double ladder 182.

As referenced in FIG. 1A, the elevator 100 utilizes guiding mechanisms having different orientations and designs to smoothly cross overlapping ladders, misalignments, and lateral instability in the double ladder 182. Those skilled in the art will recognize that the double ladder 182 comprises a first ladder 108 and a second ladder 110 that join together to slidably overlap or move in different directions relative to each other. The guiding mechanisms utilized by the elevator 100 are aligned and oriented in such a manner as to facilitate movement between the ladders 108, 110 and bring the elevator 100 into closer engagement with the double ladder 182.

To better understand the elevator 100, it is significant to note that the double ladder 182 comprises a first ladder 108 and a second ladder 110 that slidably engage each other. The first ladder 108 is oriented to engage a ground surface for support, while the second ladder 110 is oriented above the first ladder 108. The first and second ladders 108, 110 align and fasten together.

The first and second ladders 108, 110 can be a staggered, slightly misaligned configuration. The double ladder 182 may be formed from a separate first ladder 108 and second ladder 110 joined together, or as an extendable first ladder 108 with the extension being the second ladder 110. The first ladder 108 includes a pair of first side rails 160. The second ladder 110 includes a pair of second side rails 162. Both side rails 160, 162 work together to carry the elevator 100 along the double ladder 182.

As shown in FIGS. 1B and 1C, the first ladder 108 includes a plurality of first rungs 130 spanning and cross-connecting the pair of first side rails 160. Likewise, the second ladder 110 includes a plurality of second rungs 128 spanning and cross-connecting the pair of second side rails 162. In some embodiments, each first side rail 160 carries a pair of inturned flanges 164. The pair of inturned flanges 164 define a first channel 166 that faces outwardly from the first rungs 130. The outer periphery of each first side rail 160 forms a generally L-shaped first outer edge 168. The opposite end forms a first inner edge 170. In one embodiment, the pair of second side rails 162 can include hooks for latching upon the first rungs 130 to support the two ladders 108, 110 at selected telescopic positions. In one alternative embodiment, more than two ladders could join together. The elevator 100 could perform in substantially the same manner in this case.

The second side rails 162 carry a pair of outturned flanges 172. The first channel 166 is configured to receive the pair of outturned flanges 172, thereby holding the ladders 108, 110 together. The pair of outturned flanges 172 define a second channel 174 that faces inwardly towards the second rungs 128. The slidable engagement between the inturned flanges 164 and the outturned flanges 172 telescopically supports the first ladder 108 and the second ladder 110 together. Each second side rail 162 includes a second inner edge 178 that engages the first channel 166. Each second rail 162 also includes a second outer edge 176 facing opposite the second inner edge 178. The surfaces and angles formed by the aforementioned edges 168, 170, 176, 178 and flanges 164, 172 help support the various guiding mechanisms on the elevator 100.

The elevator 100 is configured to slidably traverse the double ladder 182 in a smooth, continuous path. The elevator 100 is supported on the ladder by the side rails 160, 162, which guide the elevator 100 along the length of each ladder 108, 110.

The elevator 100 forms different contact points with the double ladder 182, depending on the position on the double ladder 182. For example, FIG. 1A illustrates the elevator 100 in a first position 102 while engaging only with the first ladder 108. FIG. 1C illustrates the elevator 100 in the second position 106 while engaging only the second ladder 110. FIG. 1B illustrates the elevator 100 is in an overlap position 104 while engaging both ladders 108, 110.

The elevator 100 comprises a housing 112 defined by a housing outer surface 132, a housing inner surface 150, a housing first end 114, and a housing second end 116. The housing inner surface 150 forms the underside of the elevator 100. The housing outer surface 132 forms a protective shell for the inner components of the elevator 100. The housing first end 114 orients towards the first ladder 108, while the housing second end 116 orients towards the second ladder 110. In some embodiments, a platform 120 extends normal to the housing first end 114 to support objects as the elevator 100 traverses the double ladder 182.

FIGS. 2A and 2B illustrate four guide units 132 that mount on the housing inner surface 150. The four guide units 132 help guide the elevator 100 along the length of the double ladder 182. The four guide units 132 are effective for aligning the elevator 100 with the double ladder 182, and preventing excessive lateral movement by the elevator 100 and the double ladder 182 as the elevator 100 traverses between the first position 102 and the second position 106. The guide units 132 also bridge both ladders 108, 110, where slight misalignments between the first ladder 108 and the second ladder 110 may occur. Specifically, the guide units 132 traverse across the first side rails 160 and/or the second side rails 162, depending on the position of the elevator 100 relative to the ladders 108, 110. In one alternative embodiment, more or less guide units 132 may be utilized.

Each guide unit 184 includes guide wheels that are rotatably connected around a guide axis 138. Together, the guide wheels create a synergy that enables the elevator 100 to slidably traverse between the first and second ladders 108, 110 while maintaining an efficient contact point between the elevator 100 and each ladder 108, 110. In some embodiments, the three guide wheels may include a large guide wheel 140, a middle guide wheel 142, and a small guide wheel 144. All the guide wheels 140, 142, 144 rotate freely on a guide axis 138. The guide wheels 140, 142, 144 are spaced apart by the proper distance along the guide axis 138 to permit simultaneous engagement with the first and second side rails 160, 162.

The large guide wheel 140 helps guide the elevator 100 along the first side rail 160. The large guide wheel 140 comprises a large disc 152 engaged with a concentrically positioned small disc 154. The large disc 152 includes a large disc inner surface (not shown) that engages a first outer edge 168 of the first side rail 160. A groove 156 forms between the large disc 152 and the small disc 154. The large guide wheel 140 is operable to provide guidance from the first position 102 and the overlap position 104. At the second position 106, the large guide wheel 140 is free from engagement.

The small guide wheel 144 helps guide the elevator 100 along the second side rail 162. The small guide wheel 144 engages a second outer edge 176 on the second side rail 162. The small guide wheel 144 is grooved to ride the outturned flanges 172 that extend from the second outer edge 176. The small guide wheel 144 is operable as a guiding mechanism from the second position 106 and the overlap position 104. At the first position 102, the small guide wheel 144 is free from engagement.

The middle guide wheel 142 straddles between the first ladder 108 and the second ladder 110. The middle guide wheel 142 creates a stabilizing effect between the large guide wheel 140 and the small guide wheel 144. The middle guide wheel 142 rides through the first channel 166 and engages a second inner edge 178 formed by the second side rail 162. The middle guide wheel 142 further rotatably engages an outer surface of the second side rails 162.

Each guide unit 184, comprises of the large guide wheel 140, the small guide wheel 144, and the middle guide wheel 142, joined through the common guide axis 138 to form a structured linear extension across the first and second ladders 108, 110, such that excessive lateral movement is inhibited. However, the guide units 184 maintain sufficient play to compensate for undesirable lateral movement between the elevator 100 and the double ladder 182, and misalignments that may form in the overlap position 104.

The housing inner surface 150 further mounts four first ladder rollers 134 and four second ladder rollers 136 near opposed corners in the housing 112. The eight total rollers 134, 136 orient perpendicularly to the four guide units 184, rolling on the first outer edge 168 and the second outer edge 176 on the flanges 164, 172. The rollers 134, 136 chiefly serve to press the elevator 100 against the side rails 162. In this manner, a normal inward pressure is provided that works with the pressure applied by the four guide units 184 to create stability for the double ladder 182. The inwardly directed pressure from the rollers 134, 136 restricts forward and backward swaying by the double ladder 182. The pressure from the rollers 134, 136 also increases traction between the elevator 100 and the ladders 108, 110 for creating more efficient movement by the elevator 100. In some embodiments, the rollers 134, 136 may include rubber rollers sized to roll and balance on the first outer edge 168 and the second outer edge 176 on the flanges 164, 172.

Four of the first ladder rollers 134 rotatably engage the first ladder 108. The first ladder rollers 134 rotatably engage the first outer edge 168. Out of these four first ladder rollers 134, two are proximal to opposed outer corners on the housing first end 114, and two position near opposed outer corners of the housing second end 116. The first ladder rollers 134 are operable from the first position 102 and the overlap position 104. At the second position 106, the first ladder rollers 134 are free from engagement. In one alternative embodiment, more or less of the first ladder rollers 134 may be utilized.

Four of the second ladder rollers 136 engage from the opposite end of the double ladder 182, rolling across the second outer edge 176 of the second side rails 162. Out of these four second ladder rollers 136, two are proximal opposed outer corners on the housing first end 114, and two position near opposed outer corners of the housing second end 116. The second ladder rollers 136 are operable from the second position 106 and the overlap position 104. At the first position 102, the second ladder rollers 136 are free from engagement. In one alternative embodiment, more or less of the second ladder rollers 136 may be utilized.

The housing inner surface 150 further comprises two pairs of first ladder notched rollers 146. Each pair of first ladder notched rollers 146 is oriented perpendicularly to each other at opposed outer corners of the housing first end 114. In this manner, the two pairs of first ladder notchod rollers 146 buttress each other, and at least partially suppress vibrations and slippage between the elevator 100 and the first ladder 108. Each first ladder notched roller 146 also enhances alignment between the elevator 100 and the first ladder 108. The two pairs of first ladder notched rollers 146 are operable from the first position 102 and the overlap position 104. At the second position 106, the two pairs of first ladder notched rollers 146 are free from engagement. In one alternative embodiment, more or less of the first ladder notched rollers 146 may be utilized.

In some embodiments, the housing inner surface 150 comprises two second ladder notched rollers 148. The notched configuration of the second ladder notched rollers 148 is efficacious for suppressing vibrations and slippage between the elevator 100 and the second ladder 110. In one embodiment, the notch may include a generally V-shape. The second ladder notched rollers 148 also force a more precise alignment between the elevator 100 and the second ladder 110. The second ladder notched rollers 148 are disposed on opposed outer corners of the housing first end 114. Each second ladder notched roller 148 is arranged opposite a second ladder roller 136, creating a frictional force on the second outer edge 176. Each second ladder notched roller 148 traverses along the second side rail 162, in alignment with a corresponding second ladder roller 136. Like the second ladder roller 136, the two second ladder notched rollers 148 engage the second ladder 110 from the second position 106 and the overlap position 104, yet remains free in the first position 102. The two second ladder notched rollers 148 are operable from the second position 106 and the overlap position 104. At the first position 102, the two second ladder notched rollers 148 are free from engagement. In one alternative embodiment, more or less of the second ladder notched rollers 148 may be utilized.

Turning now to FIG. 3, a platform 120 extends normal to the housing first end 114 to support objects as the elevator 100 traverses the double ladder 182. The platform 120 may carry a variety of object, including, without limitation, people, paint buckets, construction material, and electrical material. In some embodiments, the platform 120 may include a plurality of ridged apertures for enabling fluids to pass through and providing enhanced traction. Those skilled in the art will recognize that the platform 120 forms a necessary large surface area to carry objects. For example, the double ladder 182 requires two hands to climb, thereby making the carrying of objects up the double ladder 182 difficult. The elevator 100 enables object to be carried up the double ladder 182 hands free.

In some embodiments, the platform 120 overlays a motorized and reversible winch 122 that is powered by means of a reversible motor 124; whereby the elevator 100 may be readily raised and lowered by means of simple electrical control switches for the motor 124. A pedal 180 selectively controls the direction of movement for the elevator 100. A cable 126 extends from the winch 122 upwardly towards a rung on the second ladder 110. The winch 122 draws in the cable 126 to pull the elevator 100 up towards the second ladder 110, and pays out the cable 126 to move the elevator 100 down towards the first ladder 108.

While the inventor's above description contains many specificities, these should not be construed as limitations on the scope, but rather as an exemplification of several preferred embodiments thereof. Many other variations are possible. For example, the elevator 100 could be utilized for multiple ladders of more than two individual ladders. Accordingly, the scope should be determined not by the embodiments illustrated, but by the appended claims and their legal equivalents.

What is claimed is:

1. An elevator for traversing a double ladder, the elevator comprising:

a housing configured to move along a longitudinal axis of a double ladder, the double ladder comprising a first ladder and a second ladder, the first ladder and the second ladder configured to adjustably join to one another, the housing configured to form a first position while engaging the first ladder, the housing further configured to form a second position while engaging the second ladder, the housing further configured to form an overlap position while engaging the first ladder and the second ladder, the first ladder comprising a pair of first side rails, each first side rail comprising a pair of inturned flanges configured to form a first channel, each first side rail further comprising a first inner edge and a first outer edge, the second ladder comprising a pair of second side rails, each second side rail comprising a pair of outturned flanges configured to form a second channel, each second side rail further comprising a second inner edge and a second outer edge;

four guide units configured to guide the housing along the double ladder, each guide unit comprising a large guide wheel, a small guide wheel, and a middle guide wheel, the large guide wheel, the small guide wheel, and the middle guide wheel rotatably joined with a guide axis, the large guide wheel configured to engage the pair of first side rails when the housing is disposed in the first position and the overlap position, the small guide wheel configured to engage the pair of second side rails when the housing is disposed in the second position and the overlap position, the middle guide wheel configured to engage the pair of first side rails in the first position, the middle guide wheel further configured to engage the pair of second side rails when the housing is in the second position, and the middle guide wheel further configured to engage the pair of first side rails and the pair of second side rails when the housing is in the overlap position;

four first ladder rollers configured to press the housing against the pair of first side rails, the four first ladder rollers further configured to rotatably engage the first outer edge;

four second ladder rollers configured to press the housing against the pair of second side rails, the four second ladder rollers further configured to rotatably engage the second outer edge;

two pairs of first ladder notched rollers configured to at least partially suppress vibrations and slippage between the elevator and the first ladder, the two pairs of first ladder notched rollers further configured to engage the pair of first side rails from the first position and the overlap position; and two second ladder notched rollers configured to at least partially suppress vibrations and slippage between the elevator and the second ladder, each second ladder notched roller further configured to rotatably engage a second side rail, each second ladder notched roller oriented opposite a second ladder roller, the two second ladder notched rollers further configured to engage the pair of second side rails when the housing is in the second position and the overlap position.

2. The elevator of claim 1, in which the housing comprises a housing first end, a housing second end, an inner housing surface, and an outer housing surface.

3. The elevator of claim 2, in which the large guide wheel comprises a large disc and a small disc.

4. The elevator of claim 3, in which the large guide wheel comprises a large disc inner surface configured to rotatably engage the first outer edge.

5. The elevator of claim 4, in which the small guide wheel is configured to rotatably engage the pair of outturned flanges.

6. The elevator of claim 5, in which the four first ladder rollers and the four first ladder rollers comprise rubber rollers.

7. The elevator of claim 6, in which the two pairs of first ladder notched rollers are oriented perpendicularly to each other at opposed outer corners of the housing first end.

8. The elevator of claim 7, in which the first ladder comprises a plurality of first rungs configured to join the pair of first side rails.

9. The elevator of claim 8, in which the second ladder comprises a plurality of second rungs configured to join the pair of second side rails.

10. The elevator of claim 9, in which the housing first end is disposed to join with a platform, the platform configured to form a surface for carrying an object.

11. The elevator of claim 10, in which the platform comprises a winch and a cable, the winch configured to pay out the cable for lowering the elevator, the winch further configured to draw in the cable for raising the elevator, the cable configured to join with a plurality of second rungs.

12. The elevator of claim 11, in which the platform comprises a pedal configured to operate the platform.

13. The elevator of claim 12, in which the elevator comprises a metal composition.

14. An elevator for traversing a double ladder, the elevator comprising:

a housing configured to move along a longitudinal axis of a double ladder, the double ladder comprising a first and a second ladder, the first ladder and the second ladder configured to adjustably join to one another, the housing comprising a housing first end, a housing second end, an inner housing surface, and an outer housing surface, the housing configured to form a first position while engaging the first ladder, the housing further configured to form a second position while engaging the second ladder, the housing further configured to form an overlap position while engaging the first ladder and the second ladder, the first ladder comprising a pair of first side rails, each first side rail comprising a pair of inturned flanges configured to form a first channel, each first side rail further comprising a first inner edge and a first outer edge, the second ladder comprising a pair of second side rails, each second side rail comprising a pair of outturned flanges configured to form a second channel, each second side rail further comprising a second inner edge and a second outer edge;

four guide units configured to guide the housing along the double ladder, each guide unit comprising a large guide wheel, a small guide wheel, and a middle guide wheel, the large guide wheel, the small guide wheel, and the middle guide rotatably joined with a guide axis, the large guide wheel comprising a large disc and a small disc, the large guide wheel further comprising a large disc inner surface configured to rotatably engage the first outer edge, the large guide wheel further configured to engage the pair of first side rails when the housing is in the first position and the overlap position, the small guide wheel configured to engage the pair of second side rails when the housing is in the second position and the overlap position, the small guide wheel further configured to rotatably engage the outturned flange, the middle guide wheel configured to engage the pair of first side rails in the first position, the middle guide wheel further configured to engage the pair of second side rails when the housing is in the second position, and the middle guide wheel further configured to engage the pair of first side rails and the pair of second side rails when the housing is in the overlap position;

four first ladder rollers configured to press the housing against the pair of first side rails, the four first ladder rollers further configured to rotatably engage the first outer edge, the four first ladder rollers disposed to orient perpendicularly to the four guide units;

four second ladder rollers configured to press the housing against the pair of second side rails, the four second ladder rollers further configured to rotatably engage the second outer edge, the four second ladder rollers disposed to orient perpendicularly to the four guide units;

two pairs of first ladder notched rollers configured to at least partially suppress vibrations and slippage between the elevator and the first ladder, the two pairs of first ladder notched rollers oriented perpendicularly to each other at opposed outer corners of the housing first end, the two pairs of first ladder notched rollers further configured to engage the pair of first side rails when the housing is in the first position and the overlap position; and two second ladder notched rollers configured to at least partially suppress vibrations and slippage between the elevator and the second ladder, each second ladder notched roller further configured to rotatably engage a second side rail, each second ladder notched roller oriented opposite a second ladder roller, the two second ladder notched rollers further configured to engage the pair of second side rails when the housing is in the second position and the overlap position.

15. The elevator of claim 14, in which the housing first and is disposed to join with a platform, the platform configured to provide a surface for carrying an object.

16. The elevator of claim 15, in which the platform comprises a winch and a cable, the winch configured to pay out the cable for lowering the elevator, the winch further configured to draw in the cable for raising the elevator.

* * * * *